US011047178B2

(12) United States Patent
Massey et al.

(10) Patent No.: US 11,047,178 B2
(45) Date of Patent: Jun. 29, 2021

(54) DOWNHOLE RELEASE APPARATUS

(71) Applicant: Impact Selector International, LLC, Houma, LA (US)

(72) Inventors: James Patrick Massey, Breckenridge, CO (US); Jason Allen Hradecky, Heath, TX (US)

(73) Assignee: Impact Selector International, LLC., Houma, LA (US)

( * ) Notice: Subject to any disclaimer, the term of this patent is extended or adjusted under 35 U.S.C. 154(b) by 0 days.

(21) Appl. No.: 16/586,511

(22) Filed: Sep. 27, 2019

(65) Prior Publication Data

US 2020/0157905 A1 May 21, 2020

Related U.S. Application Data

(60) Provisional application No. 62/739,663, filed on Oct. 1, 2018.

(51) Int. Cl.

| | |
|---|---|
| ***E21B 17/06*** | (2006.01) |
| ***E21B 17/02*** | (2006.01) |
| ***E21B 31/107*** | (2006.01) |

(52) U.S. Cl.
CPC ..... *E21B 17/06* (2013.01); *E21B 17/023* (2013.01); *E21B 31/107* (2013.01)

(58) Field of Classification Search
CPC ..... E21B 17/023; E21B 17/06; E21B 31/107
See application file for complete search history.

(56) References Cited

U.S. PATENT DOCUMENTS 2,060,403 A 11/1936 Sweet
2,921,634 A * 1/1960 Bloudoff ..... E21B 17/06 285/82

(Continued)

FOREIGN PATENT DOCUMENTS

EP 1197631 A3 4/2002
GB 2079347 A 1/1982

(Continued)

OTHER PUBLICATIONS

PCT/US2019/053628 Written Opinion and Search Report dated Feb. 25, 2020, 14 pages.

*Primary Examiner* — D. Andrews
(74) *Attorney, Agent, or Firm* — Boisbrun Hofman, PLLC

(57) ABSTRACT

A downhole release apparatus having a first connector sub connectable with a first portion of a tool string and a second connector sub connectable with a second portion of the tool string. The first connector sub may include a housing, a first latching member, and a blocking member. The second connector sub may include a second latching member. The first and second latching members may engage thereby connecting the first and second connector subs. The blocking member may be movable from a first position in which the blocking member prevents the first and second latching members from disengaging to a second position in which the blocking member permits the first and second latching members to disengage thereby permitting the first and second connector subs to disconnect. Relative movement between the housing and first latching member may facilitate movement of the blocking member from the first position to the second position.

21 Claims, 6 Drawing Sheets

(56) References Cited

U.S. PATENT DOCUMENTS

| | | | | | |
|---|---|---|---|---|---|
| 3,136,366 | A * | 6/1964 | Brown | E21B 17/06 166/120 |
| 4,452,472 | A * | 6/1984 | Crase | E21B 4/02 285/18 |
| 4,846,270 | A * | 7/1989 | Setterberg, Jr. | E21B 17/06 166/115 |
| 2014/0110129 | A1 | 4/2014 | Schmidt | |
| 2014/0196911 | A1 | 7/2014 | Hradecky | |

FOREIGN PATENT DOCUMENTS

| | | | |
|---|---|---|---|
| WO | 0116456 | A1 | 3/2001 |
| WO | 2014055061 | A1 | 4/2014 |
| WO | 2017118858 | A1 | 7/2017 |
| WO | 2020072325 | A1 | 4/2020 |

* cited by examiner

DOWNHOLE RELEASE APPARATUS

CROSS-REFERENCE TO RELATED APPLICATIONS

This application claims priority to and the benefit of U.S. Provisional Patent Application No. 62/739,663, titled "DOWNHOLE APPARATUS," filed on Oct. 1, 2018, the entire disclosure of which is hereby incorporated herein by reference.

BACKGROUND OF THE DISCLOSURE

Wells are generally drilled into a land surface or ocean bed to recover natural deposits of oil and gas, and other natural resources that are trapped in geological formations in the Earth's crust. Testing and evaluation of completed and partially finished wells has become commonplace, such as to increase well production and return on investment. Downhole measurements of formation pressure, formation permeability, and recovery of formation fluid samples, may be useful for predicting economic value, production capacity, and production lifetime of geological formations. Completion and stimulation operations of wells, such as perforating and fracturing operations, may also be performed to optimize well productivity. Plugging and perforating tools may be utilized to set plugs within a wellbore to isolate portions of the wellbore and subterranean rock formations surrounding the wellbore from each other and to perforate the well in preparation for fracturing. Each fracturing stage interval along the wellbore can be perforated with one or more perforating tools (i.e., perforating guns) forming one or more clusters of perforation tunnels along the wellbore. Intervention operations in completed wells, such as installation, removal, or replacement of various production equipment, may also be performed as part of well repair or maintenance operations or permanent abandonment. Such testing, completion, and intervention operations have become complicated as wellbores are drilled deeper and through more difficult materials. Consequently, in working with deeper and more complex wellbores, it has become more likely that downhole tools, tool strings, tubulars, and other downhole equipment may become stuck within a wellbore.

A downhole tool, such as an impact (i.e., jarring) tool, may be utilized to dislodge a tool string or other downhole equipment when it becomes stuck within a wellbore. The impact tool may be included as part of the tool string and deployed downhole or the impact tool may be deployed after the tool string becomes stuck. Tension may be applied from a wellsite surface to the deployed impact tool via a wireline or other conveyance means to generate elastic energy. After sufficient tension is applied, the impact tool may be triggered to release the elastic energy and deliver an impact intended to dislodge the stuck tool string. If the impact tool is not able to dislodge a stuck tool string, a release tool included in the stuck tool string may be operated to disconnect a free portion of the tool string from a stuck portion of the tool string. The release tool may be operated, for example, by applying a predetermined amount of tension either from the wellsite surface or by operating an impact tool included in the tool string to break a shear pin of the release tool. After the shear pin is broken, the release tool may be separated to uncouple upper and lower portions of the tool string from each other. Thereafter, the freed upper portion of the tool string may be removed to the wellsite surface. Fishing equipment may then be conveyed downhole to couple with and retrieve the stuck lower portion of the tool string.

Release tool shear pins are configured to break at relatively low tensions, permitting tool string separation by various means. However, such release tool shear pins also limit the amount of upward jarring force that can be applied to a stuck tool string by an impact tool in an attempt to free the tool string. Thus, an impact tool may not be utilized to impart an impact force that exceeds the breaking force limit of the release tool shear pin. Furthermore, release tool shear pins can experience wear or fatigue, which can limit the number of impacts that an impact tool can apply to a stuck tool string even when magnitudes of such impacts are below the breaking force limit of the release tool shear pin.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a downhole tool comprising: (A) a first connector sub connectable with a first portion of a tool string, wherein the first connector sub comprises: (i) a housing; (ii) a first latching member slidably connected with the housing; and (iii) a blocking member movable with respect to the first latching member; and (B) a second connector sub connectable with a second portion of the tool string, wherein the second connector sub comprises a second latching member, and wherein: (i) the first and second latching members engage thereby connecting the first and second connector subs; and (ii) the blocking member is movable from a first position in which the blocking member prevents the first and second latching members from disengaging to a second position in which the blocking member permits the first and second latching members to disengage thereby permitting the first and second connector subs to disconnect.

The present disclosure also introduces a downhole tool comprising: (A) a first connector sub connectable with a first portion of a tool string, wherein the first connector sub comprises: (i) a housing; (ii) a first latching member; and (iii) a blocking member; and (B) a second connector sub connectable with a second portion of the tool string, wherein the second connector sub comprises a second latching member, and wherein: (i) the first and second latching members engage thereby connecting the first and second connector subs; (ii) the blocking member is movable from a first position in which the blocking member prevents the first and second latching members from disengaging to a second position in which the blocking member permits the first and second latching members to disengage thereby permitting the first and second connector subs to disconnect; and (iii) relative movement between the housing and first latching member facilitates movement of the blocking member from the first position to the second position.

The present disclosure also introduces a method comprising: (A) operating a downhole tool connected between an upper portion of a tool string and a lower portion of the tool string while the lower portion of the tool string is stuck downhole, wherein the downhole tool comprises an upper portion connected with the upper portion of the tool string, wherein the downhole tool comprises a lower portion connected with the lower portion of the tool string, and wherein operating the downhole tool comprises: (i) moving the upper portion of the downhole tool upward with respect to the lower portion of the downhole tool and the lower portion of the tool string; and then (ii) moving the upper portion of the downhole tool downward with respect to the lower portion of the downhole tool and the lower portion of the tool string to unlatch the upper portion of the downhole tool from the lower portion of the downhole tool; and then (B) applying tension to the tool string to cause an upper portion of the downhole tool to separate from the lower portion of the downhole tool thereby separating the upper portion of the tool string from the lower portion of the tool string.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
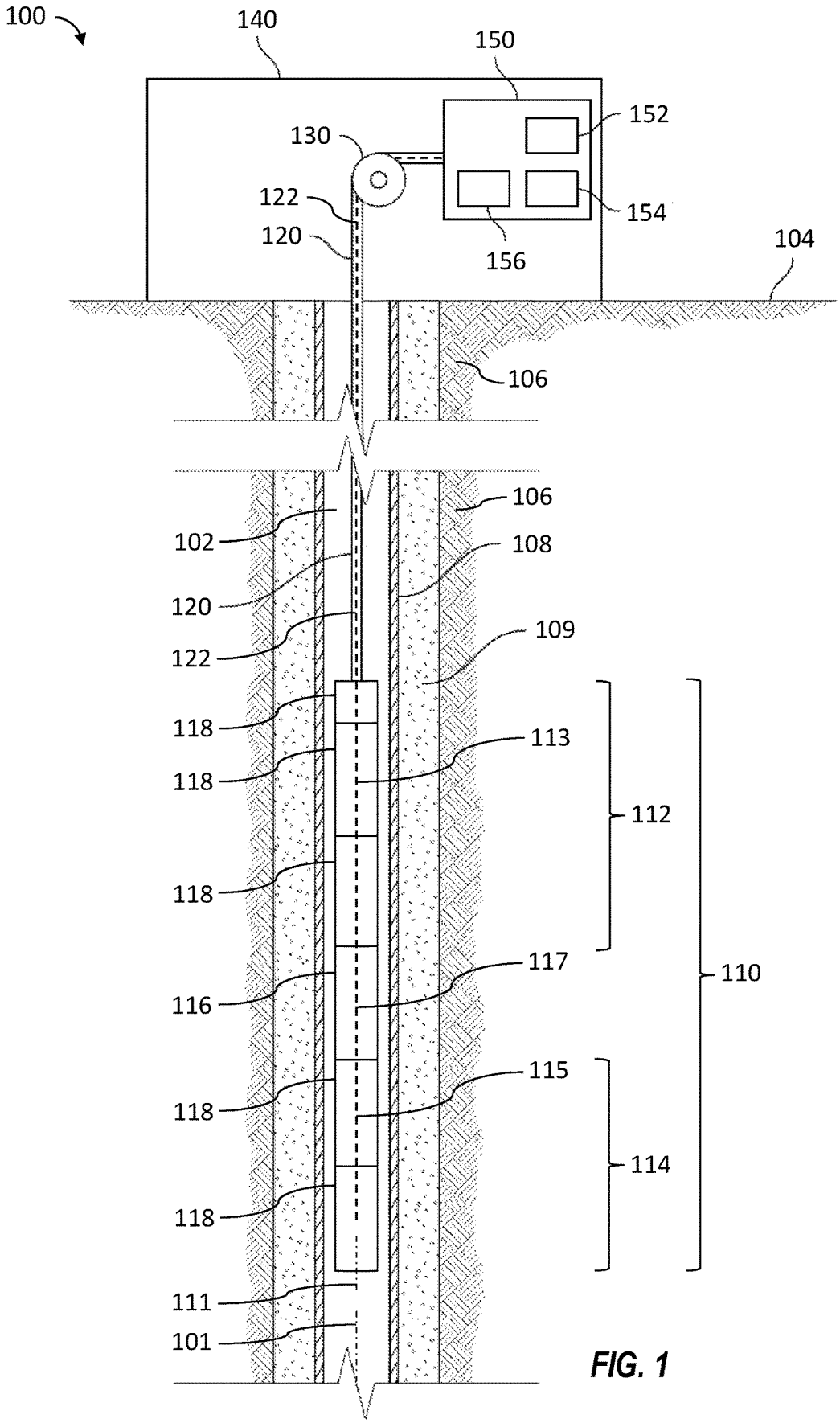
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Terms, such as upper, upward, above, lower, downward, and/or below are utilized herein to indicate relative positions and/or directions between apparatuses, tools, components, parts, portions, members and/or other elements described herein as shown in the corresponding figures. Such terms do not necessarily indicate relative positions and/or directions when actually implemented. Such terms, however, may indicated relative positions and/or directions with respect to a wellbore when an apparatus according to one or more aspects of the present disclosure is utilized or otherwise disposed within a wellbore.

FIG. 1 is a schematic view of at least a portion of a wellsite system 100 showing an example environment comprising or utilized in conjunction with a downhole tool string 110 according to one or more aspects of the present disclosure. The tool string 110 may be suspended within a wellbore 102 that extends from a wellsite surface 104 into one or more subterranean formations 106. The wellbore 102 may be a cased-hole implementation comprising a casing 108 secured by cement 109. However, one or more aspects of the present disclosure are also applicable to and/or readily adaptable for utilizing in open-hole implementations lacking the casing 108 and cement 109. The tool string 110 may be suspended within the wellbore 102 via a conveyance means 120 operably coupled with a tensioning device 130 and/or other surface equipment 140 disposed at the wellsite surface 104. The tool string 110 is shown suspended in a vertical portion of the wellbore 102, however, it is to be understood that the tool string 110 may be utilized within a non-vertical, horizontal, and otherwise deviated portion of the wellbore 102.

The tensioning device 130 may apply an adjustable tensile force to the tool string 110 via the conveyance means 120 to convey the tool string 110 along the wellbore 102. The tensioning device 130 may be, comprise, or form at least a portion of a crane, a winch, a draw-works, an injector, a top drive, and/or another lifting device coupled to the tool string 110 via the conveyance means 120. The conveyance means 120 may be or comprise a wireline, a slickline, an e-line, coiled tubing, and/or other conveyance means, and may comprise and/or be operable in conjunction with means for communication between the tool string 110, the tensioning device 130, and/or one or more other portions of the surface equipment 140, including a power and control system 150. The conveyance means 120 may comprise or contain a multi-conductor wireline and/or another electrical conductor 122 extending between the tool string 110 and the surface equipment 140, such as the power and control system 150. The power and control system 150 may include a source of electrical power 152, a memory device 154, and a surface controller 156 operable to receive and process electrical signals or information from the tool string 110 and/or commands from a human wellsite operator.

The tool string 110 may comprise an upper (e.g., uphole) portion 112, a lower (e.g., downhole) portion 114, and a release tool 116 connected between and coupling together the upper and lower tool string portions 112, 114. The release tool 116 may be selectively operable to separate, uncouple, disconnect, part, or otherwise release the upper portion 112 from the lower portion 114 or otherwise from each other, while conveyed within the wellbore 102. The release tool 116 may permit a portion (e.g., the lower portion 114) of the tool string 110 connected downhole from the release tool 116 to be left in the wellbore 102 and a portion (e.g., upper portion 112) of the tool string 110 located uphole from the release tool 116 to be retrieved to the wellsite surface 104. Accordingly, if a portion of the tool string 110 is stuck within the wellbore 102 and cannot be freed, the release tool 116 located uphole from the stuck portion of the tool string 110 may be operated to release the free portion of the tool string 110 such that it can be retrieved to the wellsite surface 104.

The upper portion 112 of the tool string 110 may comprise at least one electrical conductor 113 in electrical communication with one or more components of the surface equipment 140 via the conductor 122. The lower portion 114 of the tool string 110 may comprise at least one electrical conductor 115. The electrical conductors 113, 115 may be in electrical communication via at least one electrical conductor 117 of the release tool 116. Thus, one or more of the upper portion 112, lower portion 114, and the release tool 116 may be electrically connected with each other and with one or more components of the surface equipment 140, such as the power and control system 150, via the electrical conductors 113, 115, 117, 122. For example, the electrical conductors 113, 115, 117, 122 may transmit and/or receive electrical power, data, and/or control signals between the power and control system 150 and one or more of the upper portion 112, the lower portion 114, and the release tool 116. The electrical conductors 113, 115, 117 may further facilitate electrical communication between two or more of the upper portion 112, the lower portion 114, and the release tool 116. Each of the upper portion 112, the lower portion 114, the release tool 116, and/or portions thereof may comprise one or more electrical conductors, connectors, and/or interfaces, such as may form and/or electrically connect the electrical conductors 113, 115, 117, 122.

The upper and lower portions 112, 114 of the tool string 110 may each be or comprise at least a portion of one or more downhole tools, modules, subs, and/or other apparatuses 118 operable in wireline, while-drilling, coiled tubing, completion, production, and/or other implementations. The apparatuses 118 of the upper and lower portions 112, 114 of the tool string 110 may each be or comprise an acoustic tool, a cable head, a casing collar locator (CCL), a cutting tool, a density tool, a depth correlation tool, a directional tool, an electrical power module, an electromagnetic (EM) tool, a formation testing tool, a fluid sampling tool, a gamma ray (GR) tool, a gravity tool, a formation logging tool, a hydraulic power module, a magnetic resonance tool, a formation measurement tool, a jarring tool, a mechanical interface tool, a monitoring tool, a neutron tool, a nuclear tool, a perforating tool, a photoelectric factor tool, a plug setting tool, a porosity tool, a power module, a ram, a reservoir characterization tool, a resistivity tool, a seismic tool, a stroker tool, a surveying tool, and/or a telemetry tool, among other examples also within the scope of the present disclosure. Although the tool string 110 is shown comprising a single release tool 116, it is to be understood that one, two, three, or more additional release tools 116 may be coupled at other locations along the tool string 110 between the downhole apparatuses 118 forming the tool string 110. Multiple release tools 116 along the tool string 110 may permit a smaller or greater portion of the tool string 110 to be retrieved to the wellsite surface 104, such as based on which portion of the tool string 110 is stuck.

In an example implementation of the tool string 110, an apparatus 118 of the upper portion 112 of the tool string 110 may be or comprise a telemetry/control tool, such as may facilitate communication between the tool string 110 and the surface equipment 140 and/or control of one or more portions of the tool string 110. The telemetry/control tool may comprise a downhole controller (not shown) communicatively connected with the power and control system 150, including the surface controller 156, via conductors 113, 122 and with other portions of the tool string 110 via conductors 113, 115, 117. The downhole controller may be operable to receive, store, and/or process control commands from the power and control system 150 for controlling one or more portions of the tool string 110. The controller may be further operable to store and/or communicate to the power and control system 150 signals or information generated by one or more sensors or instruments of the tool string 110. An apparatus 118 of the tool string 110 may be or comprise inclination sensors and/or other sensors, such as one or more accelerometers, magnetometers, gyroscopic sensors (e.g., micro-electro-mechanical system (MEMS) gyros), and/or other sensors for determining the orientation of the tool string 110 relative to the wellbore 102. An apparatus 118 of the tool string 110 may be or comprise a depth correlation tool, such as a CCL for detecting ends of casing collars by sensing a magnetic irregularity caused by the relatively high mass of an end of a collar of the casing 108. The depth correlation tool may also or instead be or comprise a GR tool that may be utilized for depth correlation. The CCL and/or GR may be utilized to determine the position of the tool string 110 or portions thereof, such as with respect to known casing collar numbers and/or positions within the wellbore 102. Therefore, the CCL and/or GR tools may be utilized to detect and/or log the location of the tool string 110 within the wellbore 102, such as during deployment within the wellbore 102 or other downhole operations.

One or more apparatuses 118 of the tool sting 110 may further comprise a jarring or impact tool operable to impart an impact to a stuck portion of the tool string 110 to help free the tool string 110. The energy for the impact may be stored in the conveyance means 120 for conveying the tool string 110 into the wellbore 102. Namely, when a portion of the tool string 110 becomes stuck or jammed within the wellbore 102, the conveyance means 120 may be pulled in the uphole direction by the tensioning device 130 to build up tension and, thus, store energy in the stretched conveyance means 120. The stored energy may then be released by the impact tool, causing the impact tool to impart an impact to the stuck portion of the tool string 110. However, the energy for the impact may also or instead be stored as a pressure differential between internal and external portions of the impact tool, which may be utilized to actuate the impact tool to impart the impact to the stuck portion of the tool string 110. The energy for the impact may also or instead be imparted to a jarring tool by a stroker or ram tool, which may impart an uphole and a downhole force to the impact tool, thereby permitting the impact tool to impart impacts in the uphole and the downhole directions. A tubular jarring tool may also or instead be utilized to impart an impact in the downhole direction.

An apparatus 118 of the lower portion 114 of the tool sting 110 may be or comprise one or more perforating guns or tools, such as may be operable to perforate or form holes though the casing 108, the cement 109, and the portion of the formation 106 surrounding the wellbore 102 to prepare the well for hydraulic fracturing and/or production. The perforating tools may contain one or more shaped explosive charges operable to perforate the casing 108, the cement 109, and the formation 106 upon detonation. An apparatus 118 of the lower portion 114 of the tool string 110 may be or comprise a plug and a plug setting tool for setting the plug at a predetermined position within the wellbore 102, such as to isolate or seal a lower portion of the wellbore 102. The plug may be permanent or retrievable, facilitating the lower portion of the wellbore 102 to be permanently or temporarily isolated or sealed, such as during well treatment operations.

Figure 2:
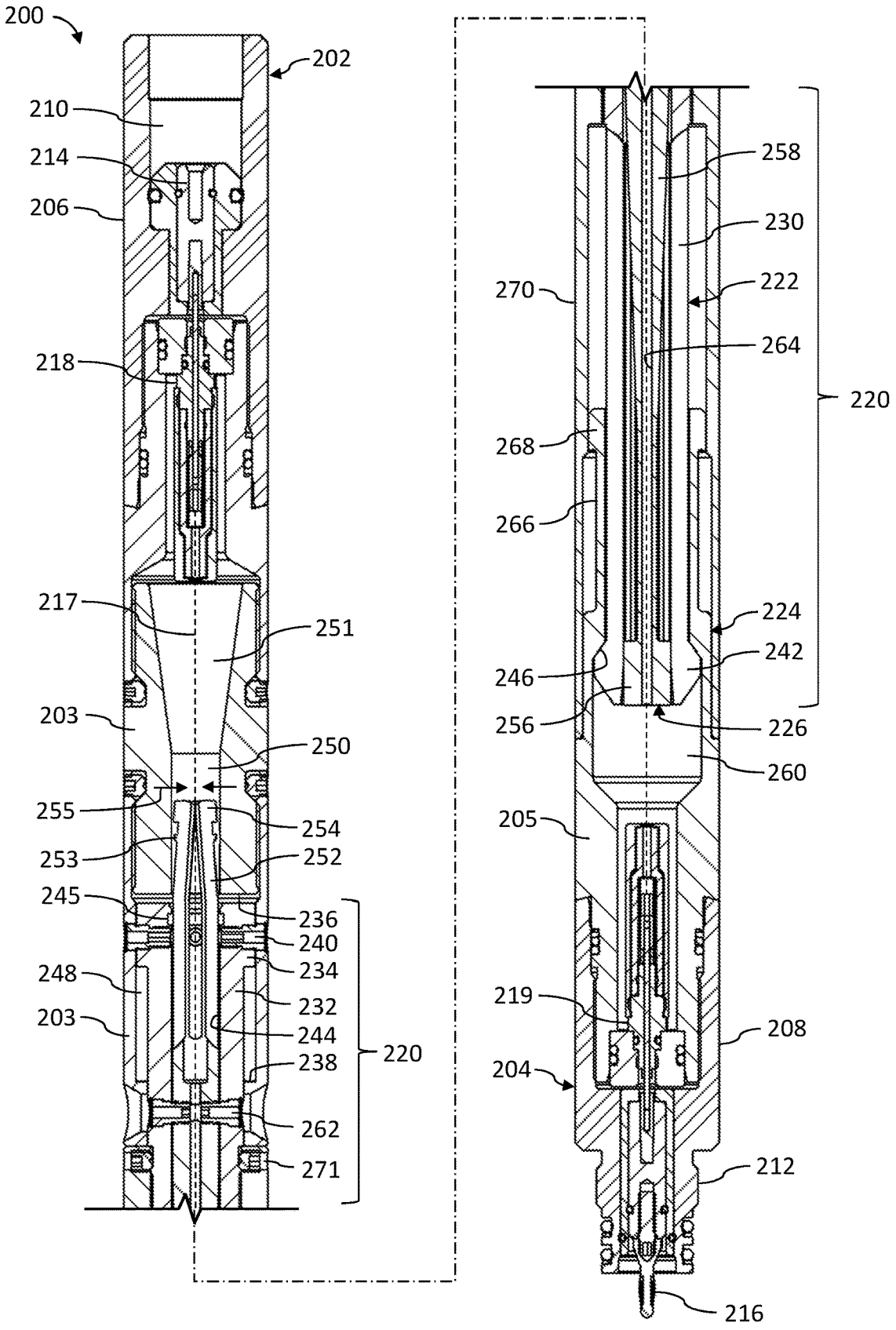
FIG. 2 is a side sectional view of at least a portion of an example implementation of apparatus according to one or more aspects of the present disclosure.

FIG. 2 is a sectional view of at least a portion of an example implementation of a release tool 200 according to one or more aspects of the present disclosure. The release tool 200 may comprise one or more features of the release tool 116 described above and shown in FIG. 1. FIG. 2 shows the release tool 200 in a normal or inactivated position (referred to hereinafter as a "first position"), in which the release tool 200 is utilized to transmit tension and compression between opposing portions of the tool string 110 comprising the release tool 200. For example, while in the first position, the release tool 200 may be operable to transmit tension generated by the tensioning device 130 during downhole conveyance of the tool string 110 to a portion of the tool string 110 located downhole from the release tool 200. The following description refers to FIGS. 1 and 2, collectively.

The release tool 200 may include an upper (e.g., uphole) connector section or sub 202 (i.e., a removable connector sub) configured to connect with the upper portion 112 of the tool string 110 and a lower (e.g., downhole) connector section or sub 204 (i.e., a remaining connector sub) configured to connect with the lower portion 114 of the tool string 110. Each connector sub 202, 204 may comprise a corresponding housing 203, 205 (or body) collectively forming or otherwise defining one or more internal spaces, volumes, bores, and/or chambers for accommodating or otherwise containing various components of the release tool 200.

Each housing 203, 205 may comprise or be connected with a corresponding head 206, 208 (e.g., a crossover), which may include connectors, interfaces, and/or other means for mechanically and electrically coupling the release tool 200 with corresponding mechanical and electrical interfaces (not shown) of the upper and lower portions 112, 114 of the tool string 110. The upper head 206 may include a mechanical interface, a sub, and/or other means 210 for mechanically coupling the release tool 200 with a corresponding mechanical interface of a downhole apparatus 118 (e.g., an impact tool) of the upper portion 112 of the tool string 110. The lower head 208 may include a mechanical interface, a sub, and/or other means 212 for mechanically coupling with a corresponding mechanical interface of a downhole apparatus 118 (e.g., a perforating gun) of the lower portion 114 of the tool string 110. Although the interface means 210, 212 are shown comprising ACME box and pin couplings, respectively, the interface means 210, 212 may alternatively comprise other pin and box couplings, threaded connectors, fasteners, and/or other mechanical coupling means.

The upper and lower interface means 210, 212 and/or another portions of the upper and/or lower heads 206, 208 may each further comprise a corresponding electrical interface 214, 216. An electrical conductor 217 (schematically shown as a dashed line) may extend between and electrically connect the electrical interfaces 214, 216. The upper electrical interface 214 may comprise means for electrically connecting the electrical conductor 217 with a corresponding electrical interface of an apparatus 118 of the upper portion 112 of the tool string 110, whereby such corresponding electrical interface may be in electrical connection with the electrical conductor 113 of the upper portion 112 of the tool string 110. The lower interface 216 may comprise means for electrically connecting the electrical conductor 217 with a corresponding electrical interface of the lower portion 114 of the tool string 110, whereby such corresponding electrical interface may be in electrical connection with the electrical conductor 115 of the lower portion 114 of the tool string 110. Although the electrical interfaces 214, 216 are shown comprising a receptacle and pin, respectively, the electrical interfaces 214, 216 may alternatively each comprise other electrical coupling means, including plugs, terminals, conduit boxes, and/or other electrical connectors.

The upper and lower heads 206, 208 and/or other portions of the housings 206, 208 may each comprise and/or contain a corresponding bulkhead connector 218, 219 configured to form a fluid seal along the electrical conductor 217, such as to prevent or inhibit wellbore fluid or other external fluid from leaking into the internal spaces, bores, or chambers of the release tool 200 along the electrical conductor 217 during downhole operations. The electrical conductor 217, the bulkhead connectors 218, 219, and the electrical interfaces 214, 216, may collectively form the electrical conductor 117 of the release tool 116, such as may facilitate electrical communication through the release tool 200.

The housing 203 of the upper connector sub 202 may comprise an inner surface defining a bore (or chamber) extending longitudinally (e.g., axially) through a portion of the upper connector sub 202. The bore may comprise a first bore portion 248, a second bore portion 250 connected with and located above the first bore portion 248, and a third bore portion 251 connected with and located above the second bore portion 250. The diameter of the first bore portion 248 may be significantly larger and the diameter of the second bore portion 250. The diameter of the third bore portion 251 may progressively increase (i.e., taper outwardly) in an upward (e.g., uphole) direction from a lower end of the third bore portion 251, adjacent the second bore portion 250, to an upper end of the third bore portion 251. The first, second, and third bore portions 248, 250, 251 may be concentrically (i.e., axially) aligned.

The release tool 200 may further comprise a latching mechanism 220 operable to latch (e.g., lock, connect, couple) together the upper and lower connector subs 202, 204, and selectively unlatch (e.g., unlock, release, disconnect, uncouple) the upper connector sub 202 from the lower connector sub 204 or otherwise from each other, while deployed within the wellbore 102. The latching mechanism 220 may be at least partially located within the internal bores of the release tool 200 and comprise an upper latching member 222, a lower latching member 224, and a blocking member 226. The upper latching member 222 and the blocking member 226 may be a portion of or be operatively connected with the upper sub 202. For example, the upper latching member 222 may be slidably (e.g., telescopically) or otherwise movably connected with the housing 203, having a limited range of motion (e.g., axial motion, longitudinal motion) with respect to the housing 203. The lower latching member 224 may be a portion of the lower connector sub 204. For example, the lower latching member 224 may be integral to or fixedly connected with the housing 205. The upper latching member 222 may be or comprise a male latching member and the lower latching member 224 may be or comprise a female latching member configured to receive the upper latching member 222. The upper and lower latching members 222, 224 may be operable to engage (e.g., latch against) each other to latch the connector subs 202, 204 and to selectively disengage (e.g., unlatch) from each other to selectively unlatch or otherwise permit separation of the connector subs 202, 204.

The blocking member 226 may be slidably disposed or otherwise movable with respect to the upper and lower latching members 222, 224 to selectively prevent the upper and lower latching members 222, 224 from disengaging and permit the upper and lower latching members 222, 224 to disengage. The blocking member 226 may be slidably or otherwise movingly disposed within or otherwise with respect to the upper latching member 222. A portion (e.g., an upper end) of the blocking member 226 may extend from or be disposed above the upper latching member 222. The blocking member 226 may be operable to block or otherwise prevent disengagement of the upper and lower latching members 222, 224 to maintain latched connection between the upper and lower latching members 222, 224 and, thus, the connector subs 202, 204. For example, the blocking member 226 can be moved from a position (referred to hereinafter as a "first position") (shown in FIG. 2) in which the blocking member 226 prevents the upper and lower latching members 222, 224 from disengaging to a position (referred to hereinafter as a "second position") (shown in FIG. 5) in which the blocking member 226 permits the upper and lower latching members 222, 224 to disengage, thereby permitting the upper and lower connector subs 202, 204 to be disconnected (e.g., released, separated, uncoupled). The blocking member 226 may also be referred to as an anti-release, anti-unlatching, or anti-disengaging member because the blocking member 226 prevents the upper and lower latching members 222, 224 and, thus, the upper and lower connector subs 202, 204 from releasing, unlatching, or disengaging.

The upper latching member 222 may comprise a plurality of flexible members 230 configured to collectively detachably engage the lower latching member 224. The flexible members 230 may be connected with and extend from a shaft 232 (or rod) slidably disposed within the first bore portion 248 extending through the upper connector sub 202. The shaft 232 may be retained within the bore portion 248 or otherwise operatively connected with the housing 203, thereby connecting the upper latching member 222 with the housing 203. For example, the shaft 232 may include a larger diameter portion 234 slidably disposed within the bore portion 248. The larger diameter portion 234 may comprise opposing outwardly extending radial shoulders (e.g., opposing ends), each configured to contact an opposing radially inward extending shoulder 236, 238 of the housing 203 to maintain the larger diameter portion 234 of the shaft 232 within the bore portion 248, thereby connecting the upper latching member 222 with the housing 203. An axial distance between the shoulders 236, 238 of the housing 203 may be greater than an axial distance between the opposing shoulders of the larger diameter portion 234, thereby permitting a limited range of axial movement of the larger diameter portion 234 and, thus, the upper latching member 222 with respect to the housing 203. The upper latching member 222 may be selectively fixedly connected with the housing 203 via one or more shear pins 240 while the release apparatus 200 is in the first position, such as when the upper shoulder of the larger diameter portion 234 is in contact with or adjacent the upper shoulder 236 of the housing 203. The shear pins 240 may extend through the housing 203 and into the larger diameter portion 234 of the upper latching member 222. Each flexible member 230 may terminate with an external (i.e., radially outward) profile 242 having an outwardly extending radial shoulder. The flexible members 230 may flex or bend to permit the external profiles 242 to move radially when the external profiles 242 are acted upon by an external force. The upper latching member 222 may further comprise an inner surface defining a bore 244 extending axially through the upper latching member 222. The bore 244 may be configured to accommodate the blocking member 226. Thus, the blocking member 226 may be slidably or otherwise movingly disposed within the bore 244 of the upper latching member 222. The inner surface of the upper latching member 222 may further comprise or define a circumferential groove or channel 245 (a larger diameter portion of the bore 244) extending radially outward.

The housing 205 and/or the lower latching member 224 may comprise an inner surface defining a bore 260 (or chamber) configured to receive or otherwise accommodate therein a portion of the upper latching member 222 while the release apparatus 200 is in the first position. The inner surface of the lower latching member 224 defining the bore 260 may further comprise or define an inwardly extending radial shoulder 246 configured to engage (e.g., contact, latch against) the outwardly extending radial shoulders of the external profiles 242 of the upper latching member 222 when the upper latching member 222 is inserted or otherwise disposed within the bore 260 of the lower latching member 224.

The blocking member 226 may be slidably disposed within the bore 244 of the upper latching member 222. An upper portion of the blocking member 226 may extend out of the bore 244 above the upper latching member 222 into the second bore portion 250 of the housing 203. The upper portion of the blocking member 226 may be or comprise a plurality of biasing (e.g., flexible) members 252, each terminating with or carrying a corresponding external profile, such as a shoulder 254, each extending in a radially outward direction. The shoulders 254 and at least a portion of the biasing members 252 may be disposed within the bore portion 250. The biasing members 252 may flex or bend to permit the shoulders 254 to be forced, compressed, or otherwise moved radially inward when disposed within the bore portion 250, as indicated by arrows 255. The biasing members 252 may bias the shoulders 254 to expand in a radially outward or otherwise lateral direction when the shoulders 254 are not disposed within the bore portion 250. One or more of the biasing members 252 may further comprise or otherwise carry a latching member 253 (e.g., a barb, a spine, a hook, etc.) extending in a radially outward direction. The latching members 253 may be configured to be at least partially received within the channel 245. While that release tool 200 is in the first position, the shoulder 236 of the housing 203 is disposed below the shoulders 254 of the blocking member 226.

A lower portion (or end) of the blocking member 226 may terminate with a blocking portion 256 (e.g., ring, sleeve) disposed between, along, against, or otherwise adjacent the external profiles 242. The blocking portion 256 may be sized or otherwise configured to prop or support the external profiles 242 by preventing or blocking the external profiles 242 from deflecting or otherwise moving radially inward toward each other. In the first position of the release tool 200, the external profiles 242 may be located below the shoulder 246 and the blocking portion 256 may prevent the profiles 242 from moving upward to a position above the shoulder 246. Accordingly, the blocking portion 256 may prevent the profiles 242 from bypassing the shoulder 246, thereby preventing the upper and lower latching members 222, 224 from disengaging and, thereby, preventing the upper and lower connector subs 202, 204 from uncoupling when tension is applied to the tool string 110.

An intermediate portion of the blocking member 226 may comprise an intermediate member 258 (e.g., a tube, a rod, a shaft) extending between and connecting the biasing members 252 and the blocking portion 256. The intermediate member 258 may progressively taper or narrow from the biasing members 252 to the blocking portion 256, whereby the intermediate member 258 adjacent or at the blocking portion 256 comprises an outer diameter that is significantly smaller than an outer diameter of the blocking portion 256 and/or significantly smaller than a radial distance between the external profiles 242. The blocking member 226 may further comprise a bore 264 extending axially through the blocking member 226. The bore 264 may be configured to accommodate the electrical conductor 217 extending through the release tool 200. The blocking member 226 may be selectively fixedly connected with the upper latching member 222 via one or more shear pins 262 while the release apparatus 200 is in the first position. The shear pins 262 may extend through the shaft 232 of the upper latching member 222 and into the intermediate member 258 of the blocking member 226.

An upper end of the lower connector sub 204, such as an upper end of the lower latching member 224, may comprise a neck 266 and/or internal or external features or profiles 268, which may be exposed when the upper connector sub 202 is disconnected and moved away from the lower connector sub 204. The neck 266 and/or internal or external features or profiles 268 may facilitate or otherwise permit the lower connector sub 204 to be coupled with wellbore fishing equipment (not shown) during fishing operations. For example, the upper end of the lower connector sub 204 may comprise one or more external cavities, protrusions, or other profiles (e.g., an external fishing neck) operable for coupling with the wellbore fishing equipment (e.g., an outside grappling device) during fishing operations. However, the lower connector sub 204 may also or instead comprise a substantially smooth or uniform outer surface, such as may permit the lower connector sub 204 to be received or captured by an overshoot fishing tool (e.g., an external catch) during fishing operations. The lower connector sub 204 may also or instead comprise one or more internal cavities, protrusions, or other profiles (e.g., an internal fishing neck profile), which may be exposed when the upper connector sub 202 is removed to permit the fishing equipment (e.g., an inside grappling device, a spear) to enter and thread into or otherwise latch against the internal profile during fishing operations.

The upper connector sub 202 may further comprise a sleeve 270 extending around the upper latching member 222 and the blocking member 226. The sleeve 270 may be connected to or carried by the upper latching member 222, such as via bolts 271 or other fasteners. The sleeve 270 may be configured to at least partially cover (e.g., extend around) the latching mechanism 220 and the fishing neck 266 while the release apparatus 200 is in the first position. The sleeve 270 may protect the latching mechanism 220 and fishing neck 266, such as during downhole conveyance of the tool string 110.

While in the first position, the release tool 200 may be operable to transmit tension and compression between upper and lower portions 112, 114 of the tool string 110. For example, during conveyance or other downhole operations, tension applied to the tool string 110 may cause the outwardly extending radial shoulders of the external profiles 242 to engage (i.e., contact) the inwardly extending radial shoulder 246 to prevent or inhibit relative motion between the upper and lower latching members 222, 224 and, thus, prevent or limit relative motion between the upper and lower connector subs 202, 204. While in the first position, the release tool 200 may be further operable to transmit impact forces generated by an impact tool in the downhole direction. While in the first position, the release tool 200 may be operable to transmit impact forces generated by an impact tool in the uphole direction, if the magnitude of such impact forces is less than the breaking force limit of the shear pins 240.

The release tool 200 may comprise a plurality of threadedly or otherwise interconnected parts or portions. For example, the upper and lower housings 203, 205 may comprise a plurality of interconnected portions collectively forming the upper and lower housings 203, 205. Accordingly, assembly of the release tool 200 may include a predetermined procedure or order of connecting the various portions of the release tool 200. For example, the upper latching member 222 may be inserted into the first bore portion 248 of a portion of the housing 203 comprising the bore portion 248. When the larger diameter portion 234 is disposed at a predetermined distance from the lower shoulder 238, the shear pins 262 may be utilized to fixedly connect the upper latching member 222 with the portion of the housing 203 comprising the bore portion 248. Thereafter, a portion of the housing 203 comprising the second and third bore portions 250, 251 may be connected with the portion of the housing 203 comprising the bore portion 248, thereby connecting the bore portions 248, 250 with the bore portion 251 and locking the larger diameter portion 234 within the bore portion 248. After the upper latching member 222 is inserted into the lower latching member 224 such that the external profiles 242 engage the shoulder 246, the blocking member 226 may be inserted into the bore 244 of the upper latching member 222 and the bore portion 250 via the bore portion 251. While the blocking member 226 is moved through the bore portion 251, the tapered sidewall of the bore portion 251 may force, compress, or otherwise move the shoulders 254 radially inward, as indicated by arrows 255, flexing or bending the biasing members 252, to permit the shoulders 254 to be disposed within the bore portion 250. After the blocking portion 256 is disposed against and/or between the external profiles 242, the blocking member 226 may be fixedly connected with the upper latching member 222 via the shear pins 262. Thereafter, the portions of the housing 203 comprising the bulkhead connector 218 and the upper interface means 210 (e.g., the upper head 206) may be connected with the portion of the housing 203 comprising the bore portions 250, 251, thereby covering the bore portion 251.

When it is intended to release an upper portion 112 of the tool string 110 coupled uphole from the release tool 200, from a lower portion 114 of the tool string 110 coupled downhole from the release tool 200, such as when the lower portion 114 of the tool string 110 is stuck within the wellbore 102, the release tool 200 may be operated to unlatch (e.g., release, unlock, disconnect) the upper connector sub 202 from the lower connector sub 204. The release tool 200 may progress though a sequence of operational stages or positions during such release operations. FIGS. 3-6 are sectional views of the release tool 200 shown in FIG. 2 in subsequent operational positions of the release operations according to one or more aspects of the present disclosure. The following description refers to FIGS. 1-6, collectively.

Figure 3:
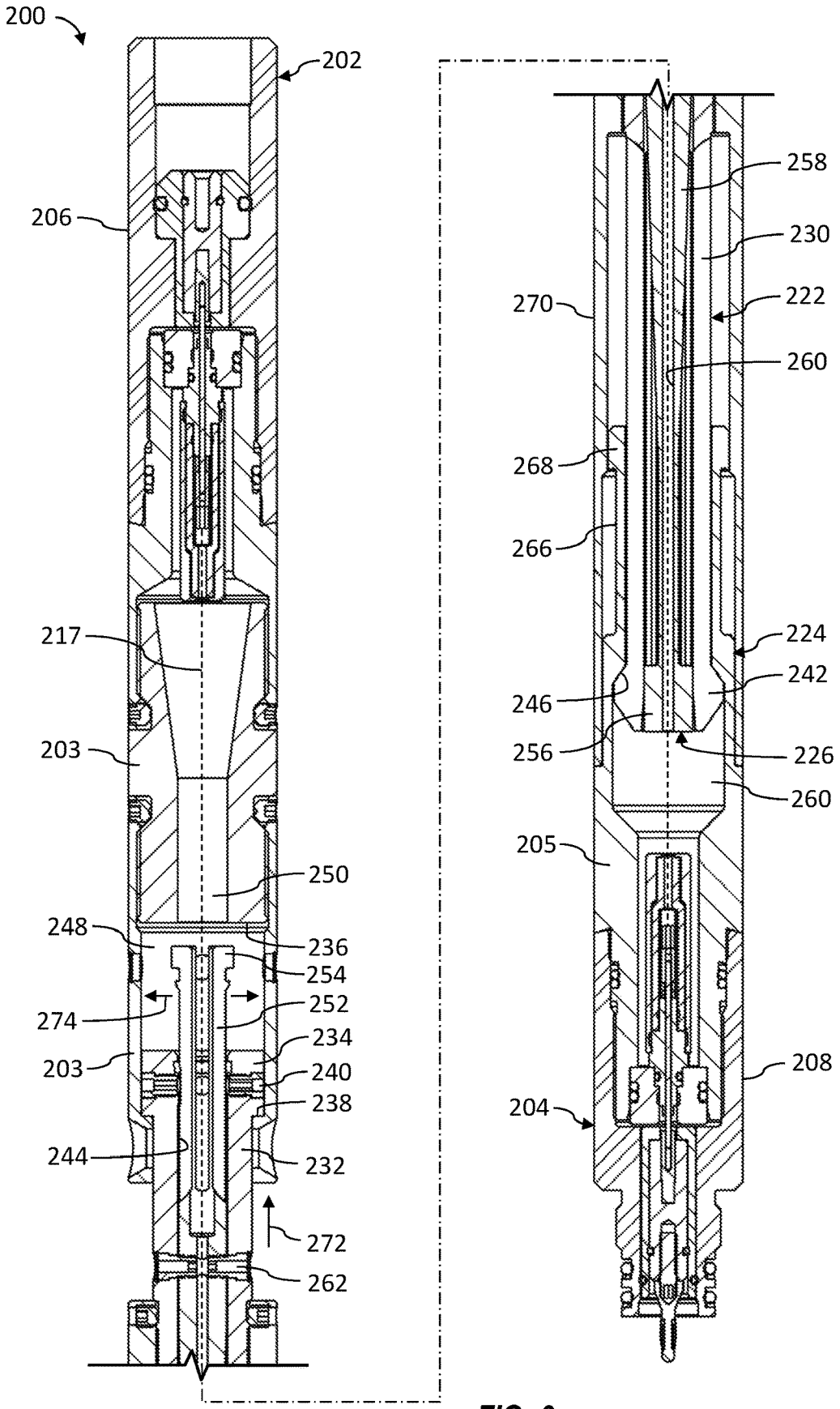
FIG. 3 is a side sectional view of the apparatus shown in FIG. 2 in another stage of operations according to one or more aspects of the present disclosure.

While the release tool 200 is in the first position, as shown in FIG. 2, the release operations may be initiated by operating an impact tool connected uphole from the release tool 200 (e.g., in the upper portion 112 of the tool string 110) to impart an uphole directed impact (i.e., jarring action) to the tool string 110. As shown in FIG. 3, the impact should impart a sufficient upward force (i.e., tension) along the release tool 200 to break the shear pins 240 and pull the housing 203 upward with respect to the upper latching member 222, as indicated by arrow 272. The upward movement of the housing 203 with respect to the upper latching member 222 may cause the shoulder 236 of the housing 203 to move from a position in which the shoulder 236 is disposed below the shoulders 254 of the blocking member 226 to a position in which the shoulder 236 is disposed above the shoulders 254. Such upward movement 272 of the housing 203 may cause the shoulders 254 (and perhaps the biasing members 252) to be withdrawn from the second bore portion 250, permitting the biasing members 252 to expand the shoulders 254 to their normal (uncompressed) state, as indicated by arrows 274. While the shoulders 254 are in their normal state, distance between outer surfaces of the shoulders 254 may be greater than the inner diameter of the bore portion 250. The housing 203 may continue to move upward until the lower shoulder 230 of the housing 203 contacts the lower shoulder of the larger diameter portion 234 of the upper latching member 222. FIG. 3 shows the release tool 200 in a transitional (e.g., intermediate, cocked) stage or position (referred to hereinafter as a "second position") of the release tool 200 during the release operations, in which the release tool 200 is ready to be operated or otherwise moved to a subsequent unlatched position of the release operations. While the release tool 200 is in the second position, the housing 203 and the upper latching member 222 cannot expand further or disconnect and, thus, the impact tool connected uphole from the release tool 200 may be operated repeatedly and/or indefinitely to impart impacts in the uphole direction to the tool string 110 until, for example, the stuck portion of the tool string 110 is freed.

Figure 4:
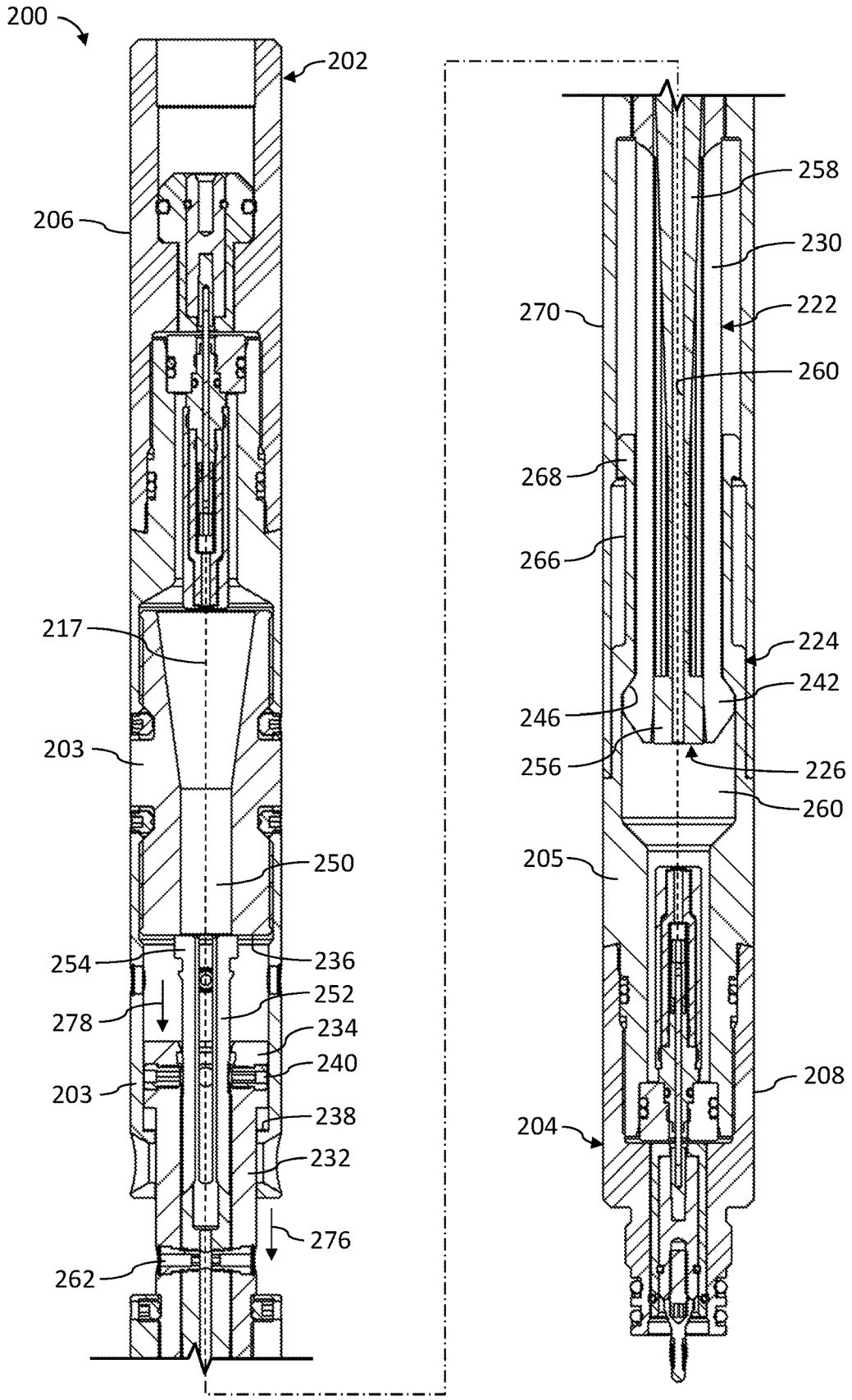
FIG. 4 is a side sectional view of the apparatus shown in FIG. 3 in another stage of operations according to one or more aspects of the present disclosure.

Thereafter, an impact tool, a stroker tool, or another tool connected uphole from the release tool 200 may be operated to impart a downward force (e.g., impact) to the tool string 110. As shown in FIG. 4, the downward force may push the housing 203 downward with respect to the upper latching member 222, as indicated by arrow 276. Such downward movement 276 of the housing 203 may cause the upper shoulder 236 of the of the housing 203 to contact the shoulders 254 of the blocking member 226 and push the blocking member 226 downward with respect to the upper latching member 222, as indicated by arrows 278. The downward force imparted to the housing 203 should have sufficient magnitude to break the shear pins 262 that connect the blocking member 226 with the upper latching member 222, thereby permitting the blocking member 226 to move downward with respect to the upper latching member 222. In an implementation of the release tool 200, the shear pins 262 may be sized or otherwise selected to permit the weight of the upper portion 112 of the tool string 110 to break the shear pins 262. For example, some or all of the weight of the upper portion 112 of the tool string 110 to be transferred to the shear pins 262 thereby causing the shear pins 262 to break by releasing some or all tension from the conveyance means 120.

Figure 5:
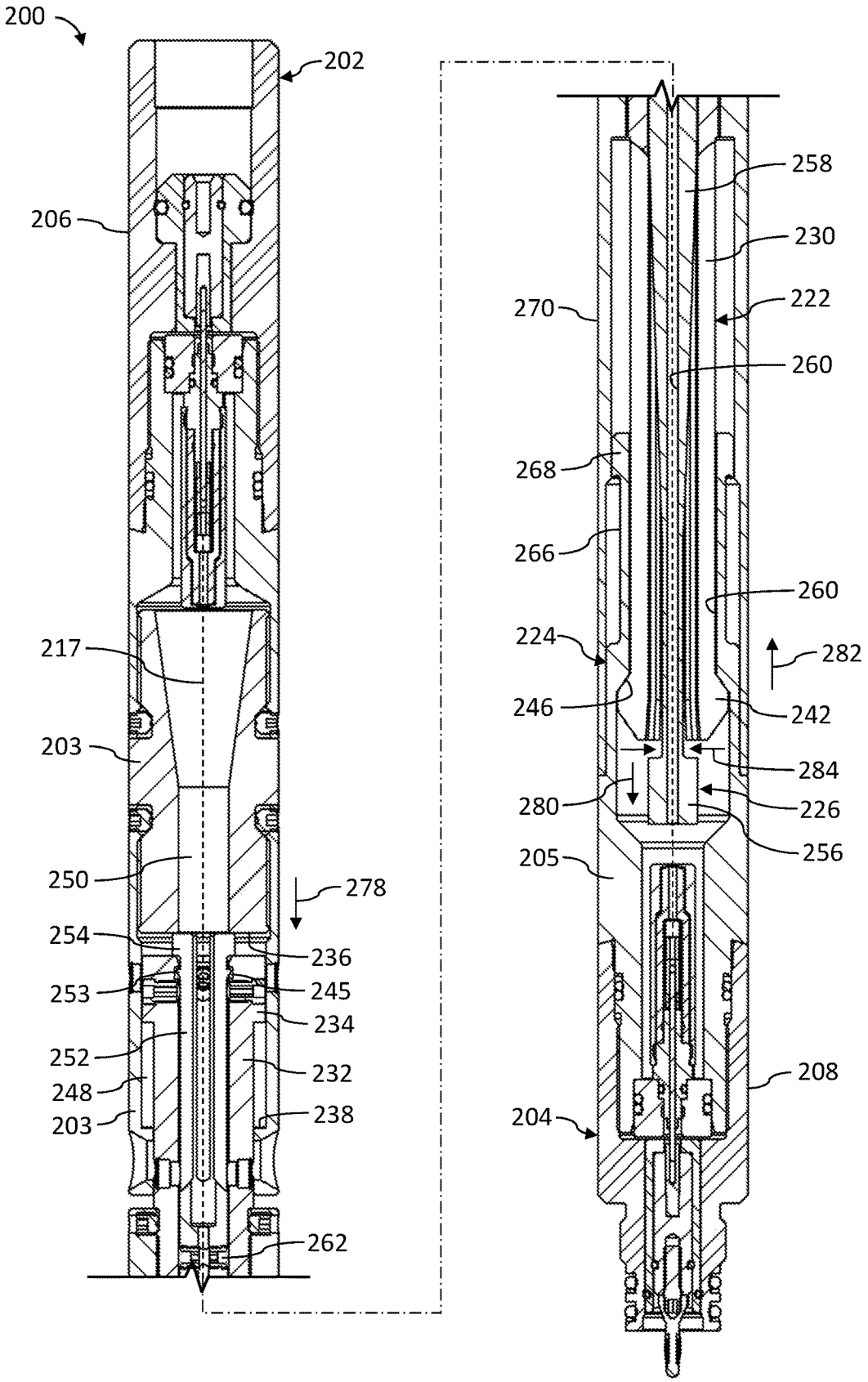
FIG. 5 is a side sectional view of the apparatus shown in FIG. 4 in another stage of operations according to one or more aspects of the present disclosure.

As shown in FIG. 5, the housing 203 may continue to be moved downward 278 with respect to the upper latching member 222, pushing the blocking member 226 downward, as indicated by arrow 280, until the blocking portion 256 moves below, is not between, or otherwise exits the external profiles 242. When the blocking portion 256 exits the external profiles 242, the latching members 253 can enter the channel 245, thereby latching the blocking member 226 with the upper latching member 222 to prevent further relative movement between the blocking member 226 and the upper latching member 222. When the blocking portion 256 exits the external profiles 242, the upper and lower latching members 222, 224 are unlatched, whereby the external profiles 242 can deflect or otherwise move radially inward toward each other, thereby permitting the upper latching member 222 to be moved (e.g., pulled) out of the lower latching member 224. The position of the release tool 200 shown in FIG. 5 may be referred to as an unlatched (e.g., releasable, unlocked, unblocked) stage or position (referred to hereinafter as a "third position") of the release operations because, while the upper latching member 222 is still within the lower latching member 224, the blocking member 226 does not block or otherwise prevent the upper and lower latching members 222, 224 and, thus, the upper and lower subs 202, 204 from separating.

Figure 6:
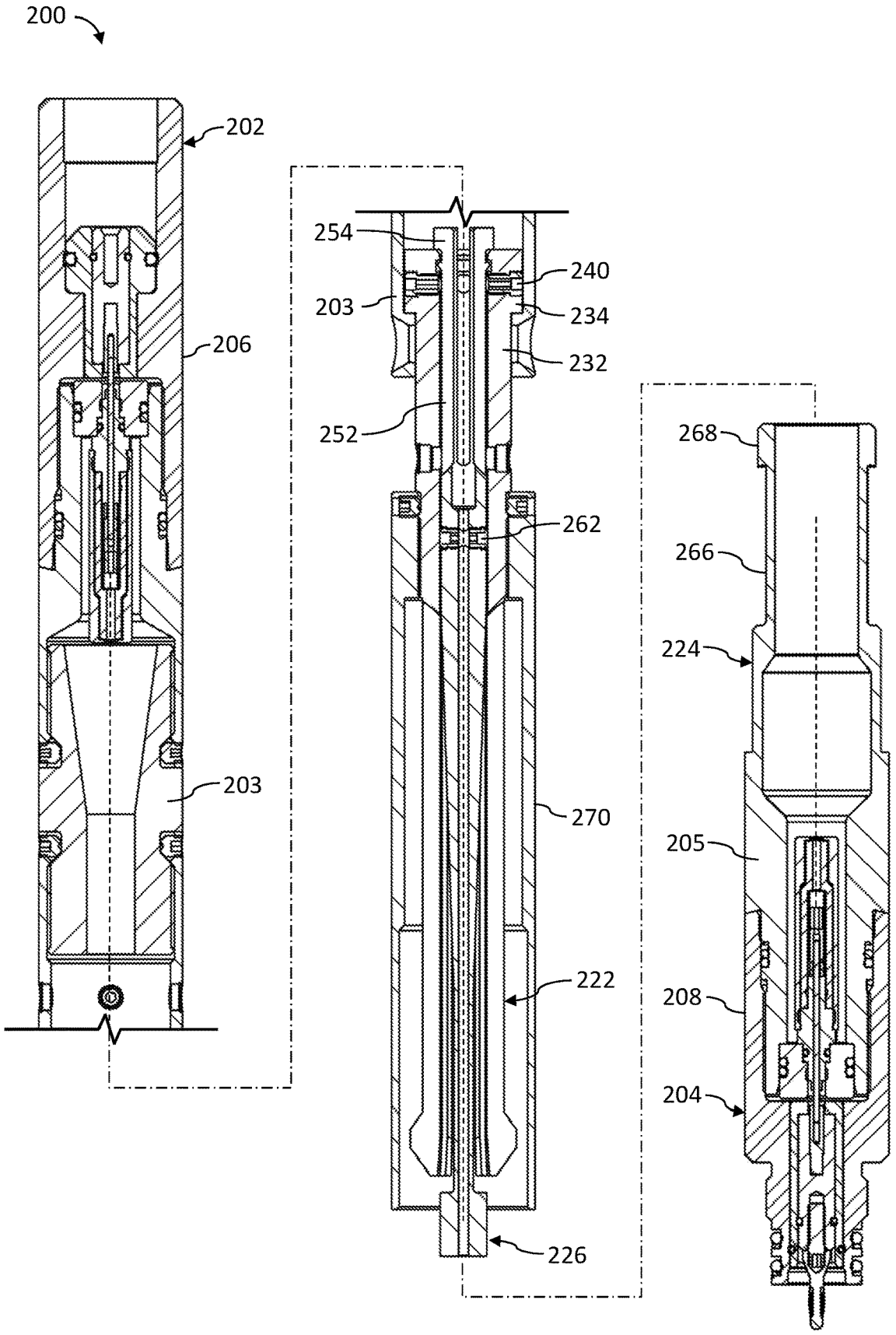
FIG. 6 is a side sectional view of the apparatus shown in FIG. 5 in another stage of operations according to one or more aspects of the present disclosure.

Thereafter, tension may be applied from the wellsite surface 104 by the tensioning device 130 to the tool string 110 via the conveyance mean 120 to separate the upper connector sub 202 from the lower connector sub 204 and retrieve the free upper portion 112 of the tool string 110 to the wellsite surface 104. When tension is applied, the upper latching member 222 of the upper sub 202 may be pulled upward with respect to the lower latching member 224 of the lower sub 204, as indicated by arrow 282, causing the shoulder 246 to force, compress, or otherwise move the external profiles 242 radially inward against the intermediate member 258, as indicated by arrows 284, thereby permitting the external profiles 242 to bypass the shoulder 246. The tension may be applied until the upper latching member 222 fully exits the lower latching member 224 to separate the upper connector sub 202 from the lower connector sub 204. FIG. 6 shows the release tool 200 in a separated stage or position (referred to hereinafter as a "fourth position") of the release operations, in which the upper connector sub 202 is fully separated or removed from the lower connector sub 204 and the neck 266 and profile 268 are exposed.

Thereafter, the uncoupled portion of the tool string 110, including the upper tool string portion 112 and the upper connector sub 202, may be returned to the wellsite surface 104. Fishing equipment (not shown) may then be deployed downhole and coupled or otherwise engaged with the neck 266 and/or profile 268, such as may permit fishing operations to be performed. Thereafter, tension may be applied from the wellsite surface 104 by the tensioning device 130 via the conveyance means 120 to the lower portion 114 (i.e., stuck portion) of the tool string 110 remaining in the wellbore 102 to free the lower portion 114 of the tool string 110.

In view of the entirety of the present disclosure, including the figures and the claims, a person having ordinary skill in the art will readily recognize that the present disclosure introduces an apparatus comprising a downhole tool comprising: (A) a first connector sub connectable with a first portion of a tool string, wherein the first connector sub comprises: (i) a housing; (ii) a first latching member slidably connected with the housing; and (iii) a blocking member movable with respect to the first latching member; and (B) a second connector sub connectable with a second portion of the tool string, wherein the second connector sub comprises a second latching member, and wherein: (i) the first and second latching members engage thereby connecting the first and second connector subs; and (ii) the blocking member is movable from a first position in which the blocking member prevents the first and second latching members from disengaging to a second position in which the blocking member permits the first and second latching members to disengage thereby permitting the first and second connector subs to disconnect.

Downward movement of the housing with respect to the first latching member may facilitate movement of the blocking member from the first position to the second position.

Downward movement of the housing with respect to the first latching member may cause the blocking member to be pushed downward from the first position to the second position.

Movement of the housing in a first direction with respect to the first latching member and then movement of the housing in a second direction with respect to the first latching member may facilitate movement of the blocking member from the first position to the second position, wherein the first and second directions are opposing directions.

Upward movement of the housing with respect to the first latching member and then downward movement of the housing with respect to the first latching member may facilitate movement of the blocking member from the first position to the second position. In such implementations, among others within the scope of the present disclosure, the housing may be movable upward and downward with respect to the first latching member via a jarring tool while: the tool string is conveyed downhole; the downhole tool is connected between the first and second portions of the tool string; and the second portion of the tool string is stuck downhole.

The housing may comprise a first shoulder, the blocking member may comprise a second shoulder, the housing may be movable upward with respect to the first latching member from a position in which the first shoulder is disposed below the second shoulder to a position in which the first shoulder is disposed above the second shoulder, the housing may then be movable downward with respect to the first latching member, and the downward movement of the housing with respect to the first latching member may cause the first shoulder to contact the second shoulder thereby pushing the blocking member downward from the first position to the second position. The first shoulder may extend in a radially inward direction, and the second shoulder may extend in a radially outward direction. The blocking member may comprise a biasing member configured to move the second shoulder in a lateral direction when the housing is moved upward with respect to the first latching member to the position in which the first shoulder is disposed above the second shoulder such that the first and second shoulders make contact when the housing is moved downward.

The blocking member may be slidably disposed within the first latching member, and a portion of the blocking member may extend out of the first latching member.

An upper end of the blocking member may be disposed above the first latching member.

The present disclosure also introduces an apparatus comprising a downhole tool comprising: (A) a first connector sub connectable with a first portion of a tool string, wherein the first connector sub comprises: (i) a housing; (ii) a first latching member; and (iii) a blocking member; and (B) a second connector sub connectable with a second portion of the tool string, wherein the second connector sub comprises a second latching member, and wherein: (i) the first and second latching members engage thereby connecting the first and second connector subs; (ii) the blocking member is movable from a first position in which the blocking member prevents the first and second latching members from disengaging to a second position in which the blocking member permits the first and second latching members to disengage thereby permitting the first and second connector subs to disconnect; and (iii) relative movement between the housing and first latching member facilitates movement of the blocking member from the first position to the second position.

The relative movement between the housing and first latching member that facilitates movement of the blocking member from the first position to the second position may comprise downward movement of the housing with respect to the first latching member to facilitate movement of the blocking member from the first position to the second position.

The relative movement between the housing and first latching member that facilitates movement of the blocking member from the first position to the second position may comprise downward movement of the housing with respect to the first latching member to cause the blocking member to be pushed downward from the first position to the second position.

The relative movement between the housing and first latching member that facilitates movement of the blocking member from the first position to the second position may comprise: movement of the housing in a first direction with respect to the first latching member; and then movement of the housing in a second direction with respect to the first latching member, wherein the first and second direction are opposing directions.

The relative movement between the housing and first latching member that facilitates movement of the blocking member from the first position to the second position may comprise: upward movement of the housing with respect to the first latching member; and then downward movement of the housing with respect to the first latching member. The housing may be movable upward and downward with respect to the first latching member via a jarring tool while: the tool string is conveyed downhole; the downhole tool is connected between the first and second portions of the tool string; and the second portion of the tool string is stuck downhole.

The housing may comprise a first shoulder, the blocking member may comprise a second shoulder, the housing may be movable upward with respect to the first latching member from a position in which the first shoulder is disposed below the second shoulder to a position in which the first shoulder is disposed above the second shoulder, the housing may then be movable downward with respect to the first latching member, and the downward movement of the housing with respect to the first latching member may cause the first shoulder to contact the second shoulder thereby pushing the blocking member downward from the first position to the second position. The first shoulder may extend in a radially inward direction, and the second shoulder may extend in a radially outward direction. The blocking member may comprise a biasing member configured to move the second shoulder in a lateral direction when the housing is moved upward with respect to the first latching member to the position in which the first shoulder is disposed above the second shoulder such that the first and second shoulders make contact when the housing is moved downward.

The first latching member and the housing may be slidably connected.

The present disclosure also introduces a method comprising: (A) operating a downhole tool connected between an upper portion of a tool string and a lower portion of the tool string while the lower portion of the tool string is stuck downhole, wherein the downhole tool comprises an upper portion connected with the upper portion of the tool string, wherein the downhole tool comprises a lower portion connected with the lower portion of the tool string, and wherein operating the downhole tool comprises: (i) moving the upper portion of the downhole tool upward with respect to the lower portion of the downhole tool and the lower portion of the tool string; and then (ii) moving the upper portion of the downhole tool downward with respect to the lower portion of the downhole tool and the lower portion of the tool string to unlatch the upper portion of the downhole tool from the lower portion of the downhole tool; and then (B) applying tension to the tool string to cause an upper portion of the downhole tool to separate from the lower portion of the downhole tool thereby separating the upper portion of the tool string from the lower portion of the tool string.

Moving the upper portion of the downhole tool upward with respect to the lower portion of the downhole tool and the lower portion of the tool string may comprise applying tension to the tool string from the wellsite surface to cause the upper portion of the tool string and the upper portion of the downhole tool to move upward with respect to the lower portion of the downhole tool and the lower portion of the tool string.

Moving the upper portion of the downhole tool upward with respect to the lower portion of the downhole tool and the lower portion of the tool string may comprise jarring the upper portion of the downhole tool upward with a jarring tool located in the upper portion of the tool string.

Moving the upper portion of the downhole tool downward with respect to the lower portion of the tool string and the lower portion of the downhole tool may comprise releasing tension from the tool string to permit gravity to cause the upper portion of the tool string and the upper portion of the downhole tool to move downward with respect to the lower portion of the tool string and the lower portion of the downhole tool.

Moving the upper portion of the downhole tool downward with respect to the lower portion of the tool string and the lower portion of the downhole tool may comprise jarring the upper portion of the downhole tool downward with a jarring tool located in the upper portion of the tool string.

The upper portion of the downhole tool may comprise a first latching member, the lower portion of the downhole tool may comprise a second latching member, the first and second latching members may engage thereby connecting the upper and lower portions of the downhole tool, the downhole tool may further comprise a blocking member slidably disposed with respect to the first and second latching members, and moving the upper portion of the downhole tool downward with respect to the lower portion of the downhole tool and the lower portion of the tool string may cause the blocking member to move from a first position in which the blocking member prevents the first and second latching members from disengaging to a second position in which the blocking member permits the first and second latching members to disengage thereby unlatching the upper portion of the downhole tool from the lower portion of the downhole tool.

The upper portion of the downhole tool may comprise a first latching member and a first shoulder, the lower portion of the downhole tool may comprise a second latching member, the first and second latching members may engage thereby connecting the upper and lower portions of the downhole tool, the downhole tool may further comprise a blocking member slidably disposed with respect to the first and second latching members, the blocking member may comprise a second shoulder, moving the upper portion of the downhole tool upward with respect to the lower portion of the downhole tool and the lower portion of the tool string may move the first shoulder upward from a position in which the first shoulder is disposed below the second shoulder to a position in which the first shoulder is disposed above the second shoulder, and moving the upper portion of the downhole tool downward with respect to the lower portion of the downhole tool and the lower portion of the tool string may move the first shoulder downward causing the first shoulder to contact the second shoulder thereby pushing the blocking member downward from a first position in which the blocking member prevents the first and second latching members from disengaging to a second position in which the blocking member permits the first and second latching members to disengage thereby unlatching the upper portion of the downhole tool from the lower portion of the downhole tool.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a downhole tool comprising:

a first connector sub comprising:

a housing connectable with a first portion of a tool string; and a first latching member, wherein the housing is movable with respect to the first latching member;

a second connector sub connectable with a second portion of the tool string, wherein the second connector sub comprises a second latching member, and wherein the first and second latching members engage thereby connecting the first and second connector subs; and a blocking member movable with respect to the first latching member, the second latching member, and the housing, wherein movement of the housing with respect to the first latching member facilitates movement of the blocking member from a first position in which the blocking member prevents the first and second latching members from disengaging to a second position in which the blocking member permits the first and second latching members to disengage thereby permitting the first and second connector subs to disconnect.

2. The apparatus of claim 1 wherein the first latching member and the housing are connected, wherein the housing is movable upward with respect to the first latching member and the blocking member when an upward force is applied to the housing, and wherein the housing is movable downward with respect to the first latching member when the upward force is stopped from being applied to the housing to thereby cause movement of the blocking member from the first position to the second position.

3. The apparatus of claim 1 wherein the first latching member and the housing are slidably connected, and wherein upward movement of the housing with respect to the first latching member and the blocking member is prevented until a predetermined upward force is applied to the housing.

4. The apparatus of claim 3 wherein subsequent downward movement of the housing with respect to the first latching member causes movement of the blocking member from the first position to the second position.

5. The apparatus of claim 1 wherein the first latching member and the housing are fixedly connected, and wherein the housing is movable upward with respect to the first latching member and the blocking member when a predetermined upward force is applied to the housing.

6. The apparatus of claim 1 wherein the first latching member and the housing are fixedly connected via a fastener, and wherein the housing is movable upward with respect to the first latching member and the blocking member when a predetermined upward force is applied to the housing to unfasten the housing from the first latching member.

7. The apparatus of claim 6 wherein the fastener is or comprises a shear pin.

8. The apparatus of claim 1 wherein upward movement of the housing with respect to the first latching member and the blocking member and then downward movement of the housing with respect to the first latching member causes movement of the blocking member from the first position to the second position.

9. The apparatus of claim 1 wherein the housing is movable upwardly with respect to the first latching member and the blocking member and then downwardly with respect to the first latching member to cause movement of the blocking member from the first position to the second position while:

the tool string is located downhole;

the downhole tool is connected between the first and second portions of the tool string; and the second portion of the tool string is stuck downhole.

10. The apparatus of claim 1 wherein the housing is movable upwardly with respect to the first latching member and the blocking member by applying an upward force to the housing while:

the tool string is located downhole;

the downhole tool is connected between the first and second portions of the tool string; and the second portion of the tool string is stuck downhole.

11. The apparatus of claim 1 wherein the housing is movable upwardly with respect to the first latching member and the blocking member by applying an upward force to the housing by a jarring tool and/or by a drawworks located at a wellsite surface while:

the tool string is located downhole;

the downhole tool is connected between the first and second portions of the tool string; and the second portion of the tool string is stuck downhole.

12. The apparatus of claim 1 wherein:

the housing comprises a first shoulder;

the blocking member comprises a second shoulder;

the housing is movable upward with respect to the first latching member and the blocking member from a position in which the first shoulder is disposed below the second shoulder to a position in which the first shoulder is disposed above the second shoulder;

the housing is then movable downward with respect to the first latching member; and the downward movement of the housing with respect to the first latching member causes the first shoulder to contact the second shoulder thereby pushing the blocking member downward from the first position to the second position.

13. The apparatus of claim 12 wherein the blocking member comprises a biasing member configured to move the second shoulder in a lateral direction when the housing is moved upward with respect to the first latching member to the position in which the first shoulder is disposed above the second shoulder such that the first and second shoulders make contact when the housing is moved downward.

14. The apparatus of claim 1 wherein a portion of the blocking member extends from the first latching member, and wherein upward and then downward movement of the housing with respect to the first latching member causes movement of the blocking member from the first position to the second position.

15. An apparatus comprising:

a downhole tool comprising:

a first connector sub comprising:

a housing connectable with a first portion of a tool string; and a first latching member;

a second connector sub connectable with a second portion of the tool string, wherein the second connector sub comprises a second latching member, and wherein the first and second latching members engage to connect the first and second connector subs and thus connect the first and second portions of the tool string; and a blocking member movable with respect to the first latching member, the second latching member, and the housing, wherein upward movement of the housing with respect to the first latching member and the blocking member and then downward movement of the housing with respect to the first latching member facilitates movement of the blocking member from a first position in which the blocking member prevents the first and second latching members from disengaging to a second position in which the blocking member permits the first and second latching members to disengage thereby permitting the first and second connector subs to disconnect and thus disconnect the first and second portions of the tool string.

16. The apparatus of claim 15 wherein the upward movement of the housing with respect to the first latching member and the blocking member is prevented via a fastener until a predetermined upward force is applied to the housing to unfasten the housing from the first latching member.

17. The apparatus of claim 16 wherein the fastener is or comprises a shear pin.

18. The apparatus of claim 16 wherein the predetermined force is applied to the housing by a jarring tool and/or by a drawworks located at a wellsite surface while:

the tool string is located downhole;

the downhole tool is connected between the first and second portions of the tool string; and the second portion of the tool string is stuck downhole.

19. The apparatus of claim 15 wherein after the housing moves upwardly with respect to the first latching member and the blocking member, the housing is movable downwardly with respect to the first latching member to cause the blocking member to move with respect to the first and second latching members from the first position to the second position.

20. The apparatus of claim 19 wherein the housing is movable upwardly and downwardly while:

the tool string is located downhole;

the downhole tool is connected between the first and second portions of the tool string; and the second portion of the tool string is stuck downhole.

21. An apparatus comprising:

a downhole tool comprising:

a first connector sub comprising:

a housing connectable with a first portion of a tool string; and a first latching member, wherein the housing is movable with respect to the first latching member;

a second connector sub connectable with a second portion of the tool string, wherein the second connector sub comprises a second latching member, and wherein the first and second latching members engage thereby connecting the first and second connector subs; and a blocking member movable with respect to the first and second latching members, wherein:

the housing is movable with respect to the first latching member to facilitate movement of the blocking member from a first position in which the blocking member prevents the first and second latching members from disengaging to a second position in which the blocking member permits the first and second latching members to disengage thereby permitting the first and second connector subs to disconnect;

the housing comprises a first shoulder;

the blocking member comprises a second shoulder;

the housing is movable upward with respect to the first latching member from a position in which the first shoulder is disposed below the second shoulder to a position in which the first shoulder is disposed above the second shoulder; and the housing is then movable downward with respect to the first latching member to cause the first shoulder to contact the second shoulder and push the blocking member downward from the first position to the second position.

* * * * *